US005951451A

United States Patent [19]

Tisch

[11] Patent Number: 5,951,451

[45] Date of Patent: Sep. 14, 1999

[54] APPARATUS FOR FITTING LID TO A CONTAINER

[75] Inventor: Ross Winston Tisch, Sanctuary Cove, Australia

[73] Assignee: L.A.S. Pty. Ltd., Southport, Australia

[21] Appl. No.: 08/586,701

[22] PCT Filed: Apr. 13, 1994

[86] PCT No.: PCT/AU94/00179

§ 371 Date: Jan. 26, 1996

§ 102(e) Date: Jan. 26, 1996

[87] PCT Pub. No.: WO95/03972

PCT Pub. Date: Feb. 9, 1995

[30] Foreign Application Priority Data

Jul. 27, 1993 [AU] Australia ..... PM0149

[51] Int. Cl.[6] ..... B65B 7/28

[52] U.S. Cl. ..... 493/103

[58] Field of Search ..... 493/102–105, 493/107, 108, 112–114, 120–122, 136–139, 156, 210, 379, 390, 393–394; 413/26, 35, 39, 37, 45

[56] References Cited

U.S. PATENT DOCUMENTS

| | | | |
|---|---|---|---|
| 1,908,216 | 5/1933 | Bergmann | 413/26 X |
| 3,385,741 | 5/1968 | Allen | 493/108 X |
| 3,460,314 | 8/1969 | Keas | 53/72 |
| 3,606,136 | 9/1971 | Hegardt . | |
| 4,047,473 | 9/1977 | Fletcher et al. | 493/108 |
| 5,016,422 | 5/1991 | Popp et al. . | |

FOREIGN PATENT DOCUMENTS

| | | |
|---|---|---|
| 65613 | 6/1981 | Australia . |
| 445721 | 9/1991 | European Pat. Off. . |
| 1411007 | 12/1965 | France . |
| 2565942 | 12/1985 | France . |
| 1461797 | 2/1969 | Germany . |
| 56-122723 | 9/1981 | Japan . |
| 329706 | 2/1991 | Japan . |
| 652369 | 11/1985 | Switzerland . |
| 1003169 | 9/1965 | United Kingdom . |

OTHER PUBLICATIONS

Int'l Search Report, dated Jul. 24, 1994.

*Primary Examiner*—Joseph J. Hail, III
*Assistant Examiner*—Anthony Ojini
*Attorney, Agent, or Firm*—Loeb & Loeb LLP

[57] ABSTRACT

The apparatus (10) for fitting lids (18) to a container (50) is disclosed. The apparatus (10) has an applicator (11,30) and a magazine (12) on which a supply of lids (18) is supported. The applicator (10) may be moved relative to the magazine (12) and pressed against the lids (18) to pick up one of the lids. By pressing the applicator into engagement with an open topped container (50) tabs (20) on the lid are bent out of the plane of the lid and the lid is fitted to the container (50).

15 Claims, 3 Drawing Sheets

APPARATUS FOR FITTING LID TO A CONTAINER

FIELD OF THE INVENTION

This invention relates to an improved lid for containers, an improved disposable container and to an apparatus for sealing containers with the lid of the invention.

BACKGROUND OF THE INVENTION

Containers of the general type to which this invention relates are usually employed for convenience foods and drinks such as ice cream, french fries and soft drinks. Containers of this type are usually intended for a single use and are then discarded. Although the containers are usually frusto conical in shape, they need not be of that shape. For example, sometimes containers of this type are of a truncated pyramidal shape. For containers of the frusto conical shape, lids of plastic material were provided. These lids were usually made of a material different from the material from which the container as a whole was made and this presented a difficulty from a re-cycling point of view. Typically, the lids had a main panel, a sealing groove and a peripheral flange. To position the lid onto a container it was necessary to press an upper peripheral lip of the container into the sealing groove. This tended to be a progressive process and required the user gradually run his fingers along the groove and press downwardly until the lid was completely in place.

Not only was the process of fitting the lid to the container difficult but the resultant sealed container could not readily be recycled in its entirety because the lid was made from a material different from the material employed for the container.

DISCLOSURE OF THE INVENTION

It is an object of the present invention to provide an improved lid, an improved container and an apparatus for fitting the lid to the container which at least minimises the disadvantages referred to above.

According to one aspect of the invention there is provided a lid for a container, the lid having a closure panel with an outer periphery and at least two tabs extending outwardly from and at spaced locations on the periphery, the tabs being coplanar with the closure panel and deformable out of the plane of the panel when mounted relative to a container.

According to another aspect, the invention provides a container to which the lid mentioned above having tabs may be attached, the container having an upper peripheral lip and a shoulder spaced from the lip by a predetermined distance corresponding to the length of the combined length of the tab and the thickness of the material from which the lid is made.

According to yet another aspect of the invention, there is provided an apparatus for fitting a lid to a container, the lid having a closure panel and at least two tabs extending therefrom and the container having a peripheral lip and a shoulder spaced from the lip by a predetermined distance, the apparatus including an applicator and a magazine for receiving a supply of lids and maintaining them in a predetermined orientation relative to the magazine, the magazine including guides for receiving the applicator, the applicator having recesses for receiving the tabs of a lid such that the applicator is able to pick up only one lid at a time and a lip receiving recess whereby, in use the applicator is adapted to pick up one lid from the magazine and to be pressed onto the lip of a container such that the tabs of the lid are bent out of the plane of the closure panel to thereby fit the lid to the container.

The lid has a closure panel and at least two tabs extending outwardly from the periphery of the panel. It is preferred that the panel be circular in shape although other shapes such as square or rectangular may also be employed. The tabs may be equally spaced around the periphery of the panel. Preferably, there may be more than two tabs and in which case, the tabs may be equally or unequally spaced around the periphery of the panel. In one embodiment the lid has four tabs equally spaced around the periphery of the panel. The tabs may have a rounded nose portion.

The lid may be made from any suitable material. Preferable, the lid is made from the same material as that from which the container is made. Waxed or polymer coated fibreboard material is preferred although the lid and container may be made of plastic or any other suitable material.

The container may have any suitable transverse cross sectional shape. Clearly, the cross sectional shape is selected to correspond to the shape of the closure panel of the lid. Shapes suitable for the lid are circular, square and rectangular. The container may conical in form although frusto conical and truncated pyramid forms are not excluded.

The container has a peripheral lip from which is spaced a shoulder against which the lid may rest when fitted to the container. The shoulder is spaced from the lip by a distance corresponding to the combined length and the thickness of the material from which the lid is made.

The magazine may have a base on which a supply of lids may rest. Although the base may be of any suitable shape, it is preferred that the base have a square shape. The base may have a spacer for locating the lowermost lid of the supply of lids at a height corresponding to the sum of the length of a tab and the thickness of the material of the lid. The spacer may consist of a platform upon which the supply of lids may rest. The platform may comprise an upstanding circular boss.

The magazine may have guides for receiving the supply of lids and which also receive the applicator. The guides are preferably present in the same number as there are tabs on the lid although this need not be the case. Preferably, there are four guides. The guides may be provided by upstanding channels or grooves. In one embodiment, upstanding posts are present extending from the base and the posts each have a groove for receiving respective tabs of the lid. The grooves also act as guides for receiving the applicator. If desired, the inverse of what has bean described may also be used. For example, the guides may have ribs and the tabs on the lids may have corresponding recesses. With such an arrangement, the applicator may be formed with recesses for receiving the ribs on the guides such that the applicator may still be received by the magazine and moved relative to it to pick up lids from the magazine for fitting of the lids to a container.

The applicator has tab receiving recesses and a lip receiving recess and is adapted for guiding engagement with the magazine. In particular, the applicator may have guide portions for engagement with the guide channels or ribs. The location of the guide portions and of the tab receiving recesses may correspond. Alternatively, the location of the guide portions and of the tabs receiving recesses may be staggered or displaced from each other. Where the lids are circular, the guide portions and the tab receiving recesses may be aligned or be radially displaced from each other.

The tab receiving recesses, as mentioned, are adapted so that the applicator picks up one lid at any one time from the supply of lids on the magazine. To achieve this the tab receiving recesses may be key hole shaped having a tapered lead in portion and a narrower second portion. The underside surface of the applicator may have a suction cap to assist in picking up one lid at a time. The applicator has a limiting member which functions to limit the distance to which the tabs may extend into the tab receiving recess. The limiting member may consist of an abutment. In one embodiment the abutment comprises an abutment surface. The suction cap is preferably provided on this surface.

The applicator may include a handle readily graspable by a user. In on embodiment the handle is substantially T shaped although other shapes may also be used.

DISCLOSURE OF THE DRAWINGS

Particular preferred embodiments of the invention will now be described by way of example with reference to the drawings in which.

DETAILED DESCRIPTION OF THE DRAWINGS

Figure 1:
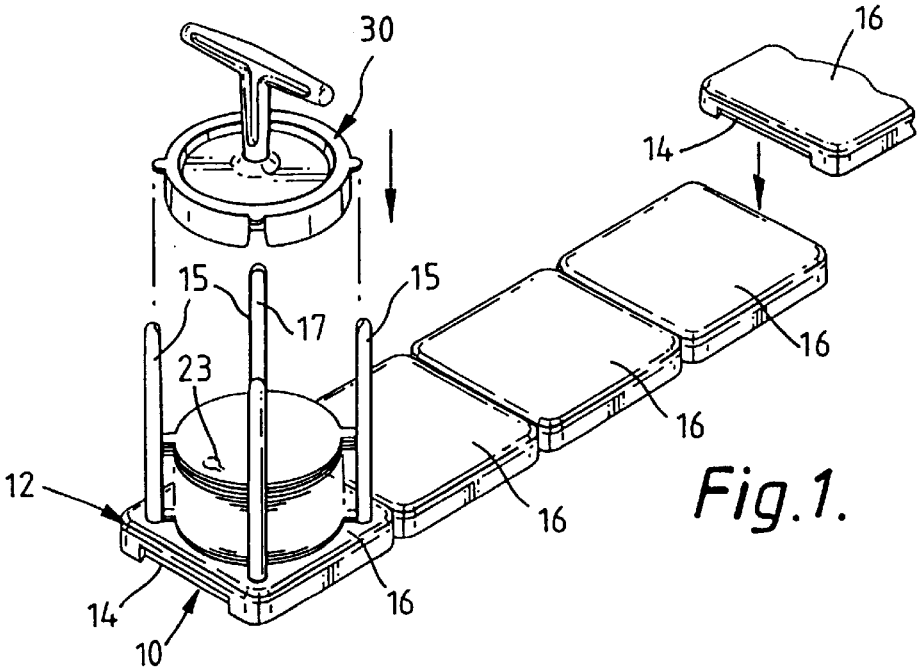
FIG. 1 is a perspective view of a plurality of apparatus according to the present invention shown connected end to end.

From FIG. 1 an apparatus 10 of an embodiment of the invention is shown. The apparatus 10 includes an applicator 30 and a magazine 12. In this figure several apparatus 10 are shown interconnected to form a single unit. This is achieved by a dovetail projection 13 (see FIG. 2) on one edge of each apparatus 10 and a correspondingly shaped dovetail recess 14 on an opposed edge of each apparatus. A plurality of apparatus each adapted to function for lids of different size may be interconnected as a single unit as shown. Alternatively, an apparatus 10 adapted for use with a particular size of lid may be used on its own.

Figure 2:
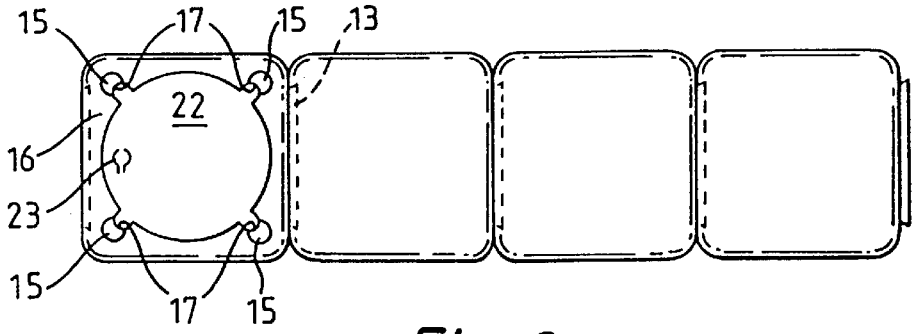
FIG. 2 is a plan view of the apparatus shown in FIG. 1.
Figure 7:
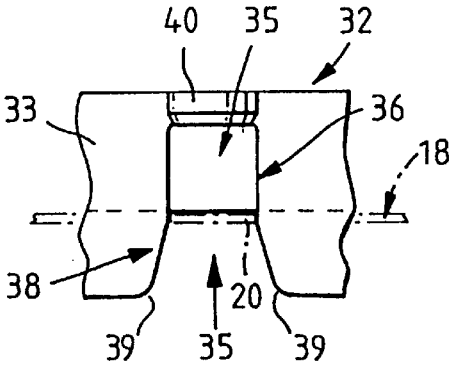
Figure 8:
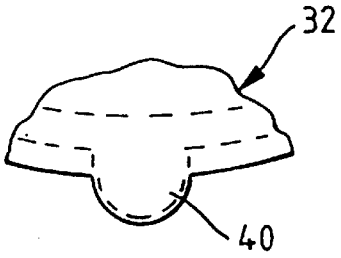

In FIG. 2 a plurality of apparatus 10 are shown. The spacing of the guides 15 on the base 16 may be adopted to suit lids of a variety of sizes. Guides 15 are only illustrated on the left hand base 16 in the figure. These guides 15 have grooves 17.

Figure 3:
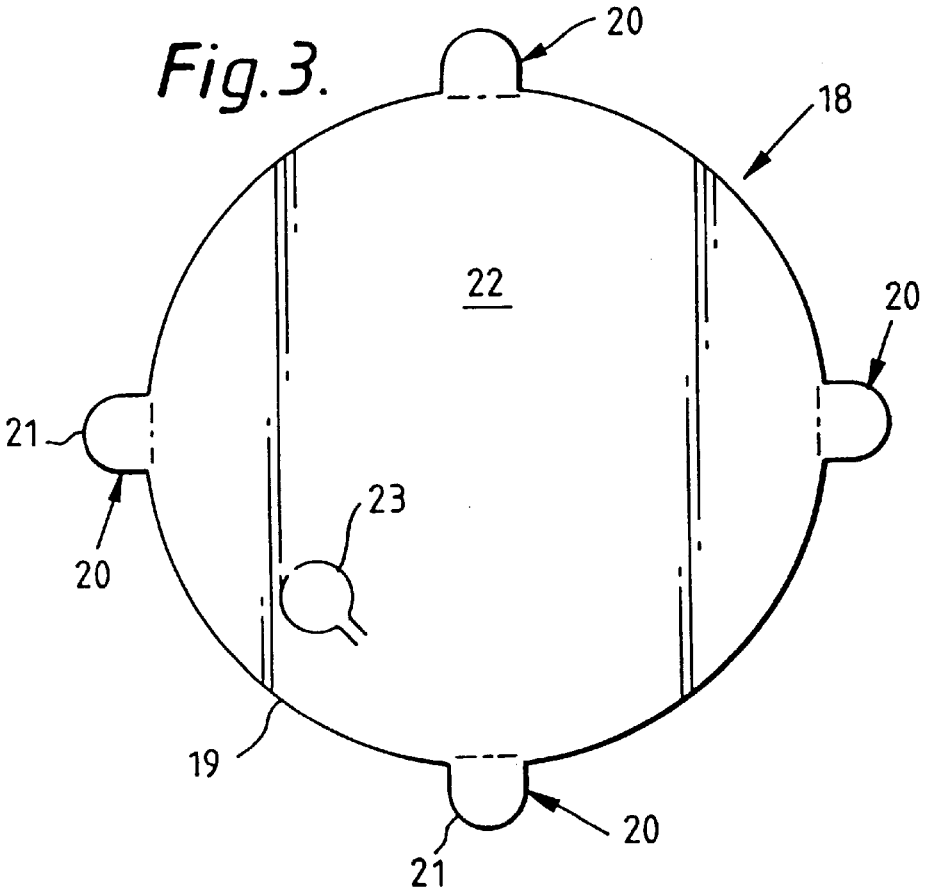
FIG. 3 is a plan view of a lid according to an embodiment of the invention.
Figure 6:
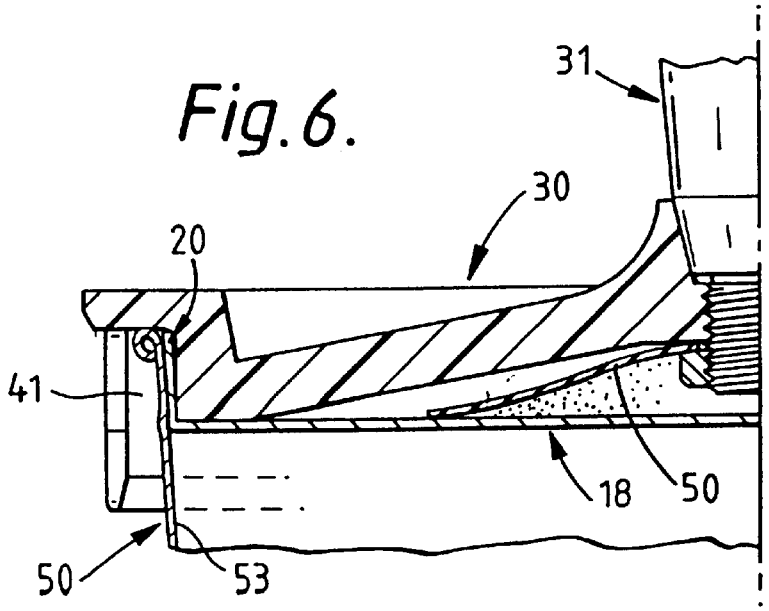
FIG. 6 is a partial sectional view useful in assisting the understanding of the operation of the apparatus of the invention; and, FIGS. 7 and 8 are partial elevational and plan views respectively of and applicator according to an embodiment of the invention.

FIG. 3 shows a lid 18 in accordance with an embodiment of the invention. The lid 18 has a periphery 19 from which extend tabs 20 having a rounded nose portion 21. These nose portions are received by grooves 17 in the guides 15. The lid 18 has a closure panel 22 which is normally co-planar with the tabs 20 and the tabs are equally spaced around the panel 22. The lid may be made from fibreboard material treated to render it moisture resistant. Any suitable material may be used. The lids have a drinking straw aperture defined by die cut portion 23.

The applicator 30 shown in FIGS. 4, 5, 6, 7 and 8 has a handle 31 graspable by a user. In this embodiment the handle is substantially T shaped although other shapes may be used. The applicator 30 has an applicator head 32. The head 32 consists of a downwardly directed skirt 33 and a circular panel 34. The skirt 33 has keyhole shaped recesses 35 (shown in greater detail in FIG. 7) of a number corresponding to the number of tabs on the lid. The recesses 35 each have a first portion 36 (see FIG. 7) with substantially parallel sides. These sides have a predetermined length. The length corresponds to a limiting member or boss 37 on an inner face of the applicator which limits the extent to which the tabs are received into the tab receiving recesses and the distance to which the lids are received into the applicator head.

In this way the head is ever only able to pick up one lid at a time. A suction cap 50*a* is secured to an inner end of stem of the handle 31. This assists in allowing the applicator to pick up one lid at a time.

Figure 4:
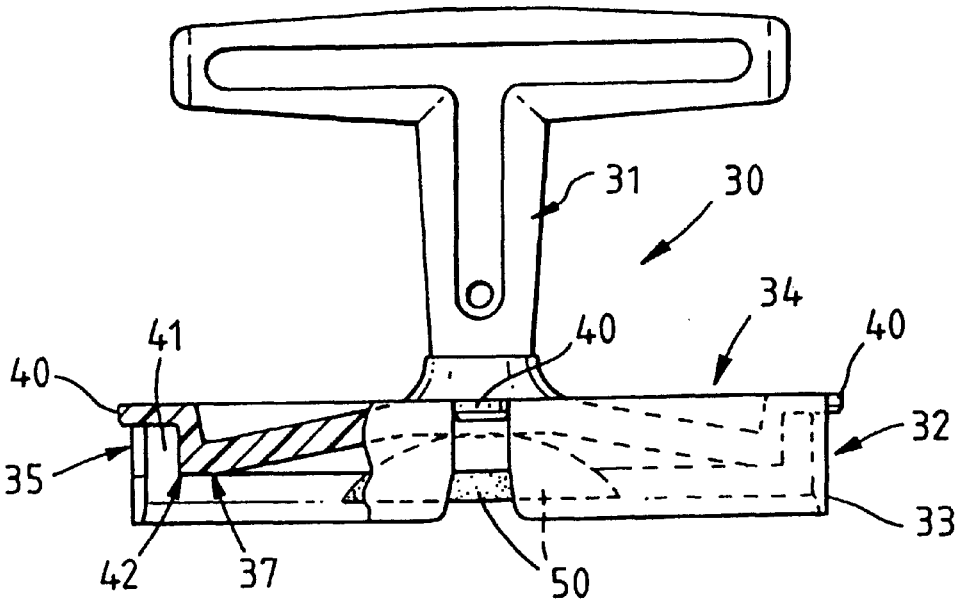
FIG. 4 is an elevational view of an applicator according to an embodiment of the invention with the applicator shown partially in section.

Each tab receiving recess has a second recess portion 38 (see FIG. 7) with inwardly converging sides. These sides of the second portion together with the boss 37 ensure that only one lid is picked at a time by the head. The second portion 38 of each recess 35 has arcuate outer edges 39 (see FIG. 7). The applicator 30 has circumferentially spaced lugs 40 arranged at even spacing around the head of the applicator and extending outwardly of the skirt 33. The lugs 40 have a curved end. Although the embodiment shown in FIG. 4 shows the lugs 40 coinciding with the location of the tab receiving recesses this need not be the case and the lugs 40 may be radially displaced from the recesses. Indeed, the number of lugs 40 need not correspond to the number of recesses.

The applicator 30 has a container lip receiving recess 41 extending around the head 32. The recess 41 has a depth corresponding to or greater then the length of the tabs 20 and of a width suitable for receiving the lip on a container. The corner 42 functions as a breaker corner to bend the tabs from their position co-planar with the closure panel 22 to a position substantially at right angles to that panel and extending along an inner face of the surrounding wall of the container.

Figure 5:
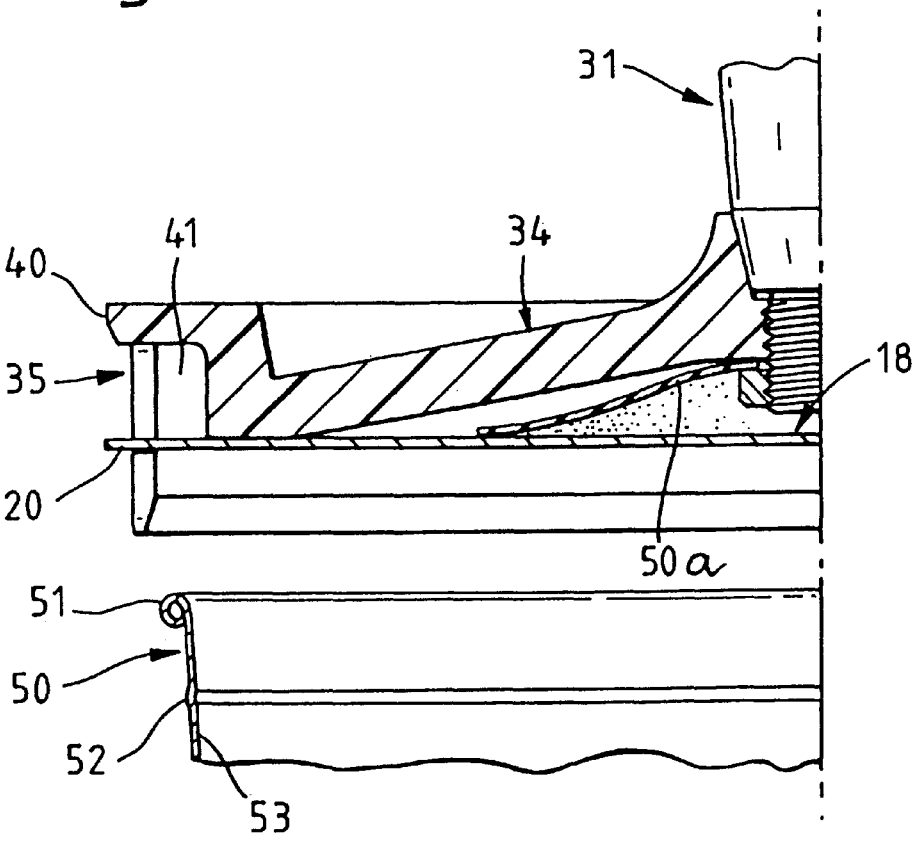
FIG. 5 is a detailed sectional view of part of a container and the applicator according to an embodiment of the invention.

FIG. 5 is a detailed sectional view of part of the applicator 30 and shows the upper periphery of a container 50. The container 50 has a rolled lip 51 and a shoulder 52 spaced from the lip 51 by a distance corresponding to the combined length of the tabs 20 on the lid and the thickness of the material from which the lid is made. When the applicator is placed over the container as shown in FIG. 5 and pressed down onto the container the lip 51 is received in the recess 41. Continued pressure of the applicator onto the container achieves the position shown in FIG. 6 with the tab bent to extend up the interior wall 53 of the container with the panel 22 of the lid located at the level of the shoulder in the container. The applicator may then be lifted from the container and the fitting of the lid is complete.

With a supply of lids positioned on the base 16 as shown in FIG. 1 the applicator 30 may be pressed onto the supply stack to pick up one of the lids. The manner in which this is achieved can best be described with reference to FIG. 7. In that Figure it can be seen that a lid 18 is received by the head 32 with tab 20 wedged within the second portion 38 of the keyhole recess. It is not possible to pick up more than one lid because portion 38 is too wide. The applicator is guided in its movement by logs 40 which locate and travel in grooves 17 provided in the guides 15 (see FIG. 1).

I claim:

1. An apparatus for fitting a lid to a container, the lid having a closure panel and at least two tabs extending therefrom and the container having a peripheral lip and a shoulder spaced from the lip by a predetermined distance, the apparatus including:

an applicator; and a magazine for receiving a supply of lids and maintaining them in a predetermined orientation relative to the magazine, the magazine including guides for receiving the applicator, the applicator having a head with a downwardly extending skirt, the skirt having tab receiving recesses with an innermost first portion consisting of a slot with parallel sides and an outermost second portion consisting of a slot with inwardly converging sides, a lip receiving recess for receiving the container having the peripheral lip, a limiting member on the underside of the head for limiting the extent to which the tabs may be received into the tab receiving recesses so that the applicator is able to pick up only one lid at a time from the magazine and allows the lid to be pressed onto the lip of the container so that the tabs of the lid are bent out of the plane of the closure panel to fit the lid to the containers.

2. The apparatus of claim 1 wherein the guides which receive the applicator also function to maintain the predetermined orientation of the lids relative to the magazine.

3. The apparatus of claim 2 wherein the guides include guide grooves for receiving the tabs and for receiving the applicator for guiding the movement of the applicator towards the supply of lids on the magazine.

4. The apparatus of claim 3 wherein the magazine has a base upon which the supply of lids is received and the guides comprise upstanding posts extending from the base.

5. The apparatus of claim 4 wherein the base has complementary engaging portions on spaced edges to enable a plurality of said apparatus to be coupled together as a unit.

6. The apparatus of claim 1 wherein the applicator has guide lugs co-operable with the guides of the magazine for guiding the applicator for movement relative to the magazine.

7. The apparatus of claim 6 wherein the guide lugs and the tab receiving recesses on the applicator are located at common locations at spaced locations on the periphery of the applicator.

8. The apparatus of claim 7 wherein the limiting member comprises a boss.

9. The apparatus of claim 7 wherein the lip receiving recess is located between the skirt and the limiting member.

10. The apparatus of claim 6 including at least four said lugs and four said tab receiving recesses.

11. The apparatus of claim 1 wherein the applicator includes a handle extending from the head.

12. The apparatus of claim 1 wherein the limiting member has a predetermined length and wherein the first and second portions of the tab receiving recesses meet at a junction and the junction is adjacent an outmost face of the limiting member against which a lid abuts in use.

13. The apparatus of claim 1 including a suction cap on an underside of the applicator for assisting the applicator in picking up one lid at a time.

14. An apparatus for fitting a lid to a container, the lid having a closure panel and at least two tabs and the container having a peripheral lip and a shoulder spaced from the lip by a predetermined distance, the apparatus comprising:

an applicator; and a magazine for receiving a supply of lids and maintaining them in a predetermined orientation relative to the magazine, the magazine including guides for receiving the applicator, the applicator having recesses for receiving the tabs of the lid such that the applicator is able to pick up only one lid at a time from the magazine;

guide lugs co-operable with the guides of the magazine for guiding the applicator for movement relative to the magazine; and a lip receiving recess, wherein when the applicator is pressed onto the lip of the container, the tabs of the lid are bent out of the plane of the closure panel to fit the lid to the container.

15. An apparatus for fitting a lid to a container, the lid having a closure panel and at least two tabs and the container having a peripheral lip and a shoulder spaced from the lip by a predetermined distance, the apparatus comprising:

an applicator; and a magazine for receiving a supply of lids and maintaining them in a predetermined orientation relative to the magazine, the magazine including guides for receiving the applicator, the applicator having recesses for receiving the tabs of the lid such that the applicator is able to pick up only one lid at a time from the magazine;

guide lugs co-operable with the guides of the magazine for guiding the applicator for movement relative to the magazine, wherein the guide lugs and the recesses for receiving the tabs on the applicator are located at common locations spaced on the periphery of the applicator; and a lip receiving recess, wherein when the applicator is pressed onto the lip of the container, the tabs of the lid are bent out of the plane of the closure panel to fit the lid to the container.

* * * * *